US009809908B2

(12) United States Patent
Wong

(10) Patent No.: US 9,809,908 B2
(45) Date of Patent: Nov. 7, 2017

(54) ELECTROSPUN MICROTUBES AND NANOTUBES CONTAINING RHEOLOGICAL FLUID

(71) Applicant: Shing-Chung Wong, Copley, OH (US)

(72) Inventor: Shing-Chung Wong, Copley, OH (US)

(73) Assignee: University of Akron, Akron, OH (US)

( * ) Notice: Subject to any disclaimer, the term of this patent is extended or adjusted under 35 U.S.C. 154(b) by 840 days.

(21) Appl. No.: 14/159,164

(22) Filed: Jan. 20, 2014

(65) Prior Publication Data

US 2015/0275401 A1 Oct. 1, 2015

Related U.S. Application Data

(63) Continuation of application No. 13/359,020, filed on Jan. 26, 2012, now abandoned.

(60) Provisional application No. 61/436,423, filed on Jan. 26, 2011.

(51) Int. Cl.

| | |
|---|---|
| ***D01D 5/00*** | (2006.01) |
| ***D01D 5/24*** | (2006.01) |
| ***D04H 1/728*** | (2012.01) |
| ***D01F 1/10*** | (2006.01) |
| ***D01F 6/12*** | (2006.01) |

(Continued)

(52) U.S. Cl.

CPC ..... *D01F 1/10* (2013.01); *D01D 5/0046* (2013.01); *D01D 5/0069* (2013.01); *D01D 5/24* (2013.01); *D01D 5/34* (2013.01); *D01F 6/12* (2013.01); *D04H 1/728* (2013.01); *F41H 5/0485* (2013.01); *Y10T 428/139* (2015.01); *Y10T 428/1393* (2015.01); *Y10T 428/268* (2015.01); *Y10T 442/2008* (2015.04); *Y10T 442/612* (2015.04)

(58) Field of Classification Search

CPC ..... D01D 5/0046; D01D 5/0069; D01D 5/24; D01D 5/34; D01F 1/10; D01F 6/12; D04H 1/728; Y10T 428/139; Y10T 428/1393; Y10T 428/268; Y10T 442/612; Y10T 442/2008; F41H 5/0485

USPC ..... 428/36.9, 36.91, 36.92; 442/338

See application file for complete search history.

(56) References Cited

U.S. PATENT DOCUMENTS

| | | | | |
|---|---|---|---|---|
| 7,137,496 | B2 * | 11/2006 | Sheng | F16D 37/008 188/267.1 |
| 2003/0049442 | A1 * | 3/2003 | Zhou | D01F 8/06 428/364 |
| 2007/0107778 | A1 * | 5/2007 | Bettin | A42B 3/121 137/13 |

FOREIGN PATENT DOCUMENTS

| | | | |
|---|---|---|---|
| WO | WO 2004/079832 | * | 9/2004 |
| WO | WO 2008/115636 | * | 9/2008 |

* cited by examiner

*Primary Examiner* — Yan Lan

(74) *Attorney, Agent, or Firm* — Renner Kenner Greive Bobak Taylor & Weber

(57) ABSTRACT

Microscale and nanoscale tubular structures are provided including rheological fluids in their interior volume and including at least one electroactive component. Multiple tubular structures are provided, including simple hollow tube structures; core/shell structures, wherein the tube includes a tubular outer shell with a core extending axially therein; concentric tube or coaxial tube structures, wherein the tube includes a tubular outer shell and one or more concentric tubes extending axially therein; and core/concentric tube structures, wherein concentric tubes further include a core extending axially therein, thus having a core and two or more tubes surrounding the core. The tubular structures are formed by electrospinning and special spinnerets are (Continued)

provided. The tubular structures form fabrics for beneficial uses.

10 Claims, 13 Drawing Sheets

(51) Int. Cl.
*F41H 5/04* (2006.01)
*D01D 5/34* (2006.01)

UPON IMPACT

- CORE IS CHARGED
- NANO-PARTICLES PERCOLATE
- ERF TURNS INTO SOLID

PROJECTILE DEPARTURE

- CORE TURNS NEUTRAL
- NANO-STREAKS DISASSEMBLE
- ERF DRAINS ENERGIES AWAY

ELECTROSPUN MICROTUBES AND NANOTUBES CONTAINING RHEOLOGICAL FLUID

CROSS-REFERENCE TO RELATED APPLICATIONS

This application is a Continuation of U.S. patent application Ser. No. 13/359,020, filed Jan. 26, 2012, which claims priority from U.S. provisional patent application Ser. No. 61/436,423 filed on Jan. 26, 2011, both of which are incorporated herein by reference in its entirety.

FIELD OF THE INVENTION

The present invention relates to tubular structures in the microscale and nanoscale. More particularly it relates to microtubes and nanotubes containing electro-rheological and/or magneto-rheological fluids. This invention also relates to electrospinning and spinnerets for use in the electrospinning process. In particular applications, these microtube and nanotubes might be used in dry adhesive applications and armor applications.

BACKGROUND OF THE INVENTION

Electrospinning has been employed to create various types of microscale and nanoscale tubes, often called microtubes or nanotubes. These are typically made from polymers and other materials suitable for electrospinning, and processes for their creation typically include coaxially spinning two materials and then extracting the center material to leave a hollow core and form a tube structure. The present invention improves on the art of microtubes and nanotubes by providing tubular structures that respond to applied pressure or electromagnetic fields. The response to mechanical stress or electromagnetic fields is a result of two components of the tubular structure, electroactive polymer and rheologic fluid. The structures will have many applications.

As a result of their shape and components, these tubular structures may find application as synthetic muscle fibers, sensors and actuators, nerve conduits and blood capillaries.

They might also find application as dry adhesives. A mass of spun fibers or tubes can be formed that somewhat mimics the hierarchical structures of fine fibrils on the feet of insects and other animals, for example, gecko lizards. These structures induce strong molecular forces and provide extraordinary adhesive strength, enabling them to support large loads and even climb and run on wet or dry molecularly smooth surfaces. This dry adhesion allows such animals to move on slippery surfaces against gravity as well as firmly attach onto and detach from rough substrates. The art of dry adhesion would benefit from the creation of structures that can mimic the dry adhesion of such animals. This could lead to the creation of spiderman suits and civilian and military clothing.

There is also a drive to provide protective fabrics for various applications, be it in clothing (e.g., bullet-proof clothing) or other protective coverings. The tubular structures of the present invention might be employed in such applications.

SUMMARY OF THE INVENTION

In a first embodiment, the present invention provides a tubular structure in the nanoscale or microscale, the tubular structure comprising: (a) at least one tube defining an interior volume; (b) optionally, a core material inside said interior volume, wherein if said core material is present, at least one of said core material and said at least one tube is formed of an electroactive polymer, and, if said core material is not present, said tube is formed of an electroactive polymer; and (c) a rheological fluid retained within the tubular structure.

In a second embodiment, the present invention provides a tubular structure as in the first embodiment, wherein said rheological fluid is selected from electro-rheological fluid and magneto-rheological fluid.

In a third embodiment, the present invention provides a tubular structure as in either the first or second embodiment, wherein said core material is not present, and said at least one tube is a single tube, said rheological fluid being retained in said single tube.

In a fourth embodiment, the present invention provides a tubular structure as in any of the first through third embodiments, wherein said core material is present, and said at least one tube is a single tube surrounding said core material so as to define an annular space between said core material and said tube, said rheological fluid being retained in said annular space.

In a fifth embodiment, the present invention provides a tubular structure as in any of the first through fourth embodiments, wherein said at least one tube includes a first inner tube and a second outer tube concentric therewith so as to define an annular space between said first inner tube and said second outer tube.

In a sixth embodiment, the present invention provides a tubular structure as in any of the first through fifth embodiments, wherein said core material is present and is surrounded by said first inner tube so as to define an inner annular space between said core material and said first inner tube, said rheological fluid being retained in one or both of said inner annular space and said annular space.

In a seventh embodiment, the present invention provides a tubular structure as in any of the first through sixth embodiments, wherein said core material is not present, such that said first inner tube defines a hollow interior space, said rheological fluid being retained in one or both of said hollow interior space and said annular space.

In an eight embodiment, the present invention provides a tubular structure as in any of the first through seventh embodiments, wherein said electroactive polymer is polyvinyldenefluoride (PVDF).

DETAILED DESCRIPTION OF ILLUSTRATIVE EMBODIMENTS

The present invention provides microscale and nanoscale tubular structure including rheological fluids in their interior volume. In some embodiments, the tubular structures have a core/shell structure, wherein the tube includes a tubular outer shell with a core extending axially therein. In some embodiments the tubular structures have a concentric tube or coaxial tube structure, wherein the tube includes a tubular outer shell and one or more concentric tubes extending axially therein. In some embodiments, the concentric tubes further include a core extending axially therein, thus having a core and two or more tubes surrounding the core, this tubular structure being referred to as a core/concentric tube structure. Herein, these structures are broadly referred to as tubular structures, though it is again noted that they are taught to be in the microscale or nanoscale dimensions in diameter. It is simply verbose to continually refer to them as "microscale or nanoscale tubular structures" so the terms microscale and nanoscale are often not used.

It should be appreciated that though the terms "concentric" or "coaxial" might be employed herein to describe some tubular structures, those of ordinary skill in the art appreciate that the tubular structures disclosed herein might deviate from true concentricity or coaxial relations because the materials and processes used in creating the tubular structures can result in deforming of the tubes during creation. Nevertheless those knowledgeable in the art still employ these terms and the terms accurately apply to the end structures. It should also be appreciated that the term "tubular" is to be broadly interpreted to include tube-like structures that are not circular in cross section. These structures can be produced by co-axial electrospinning and/or with multiple solvents extraction techniques.

Processes for the creation of microscale and nanoscale tubes with or without cores and concentric tubes are generally known, though, in another embodiment, the present invention also provides a novel coaxial electrospinning methodology for the creation of a core/shell structures and concentric tube structures and core/concentric tube structures.

Figure 1A:
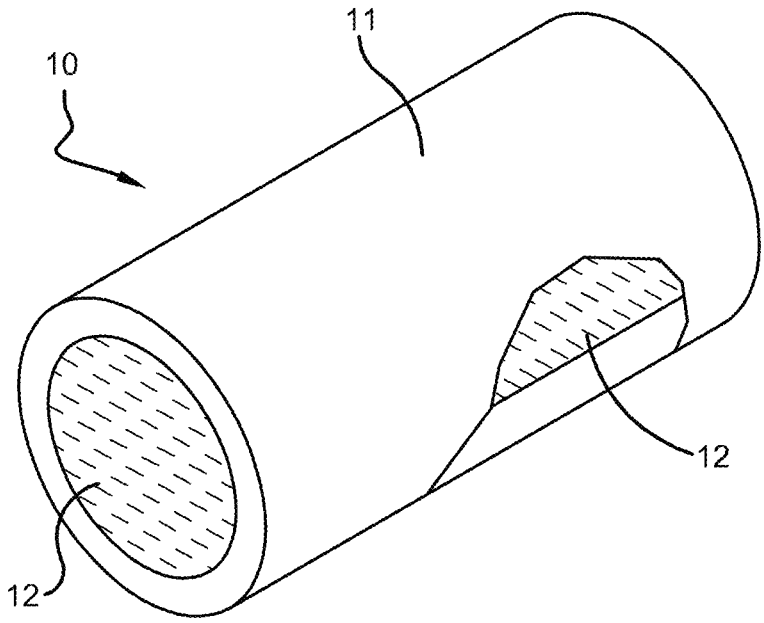
FIG. 1*a* provides a perspective view and FIG. 1*b* provides a front elevational view of a first tubular structure in accordance with this invention.
Figure 1B:
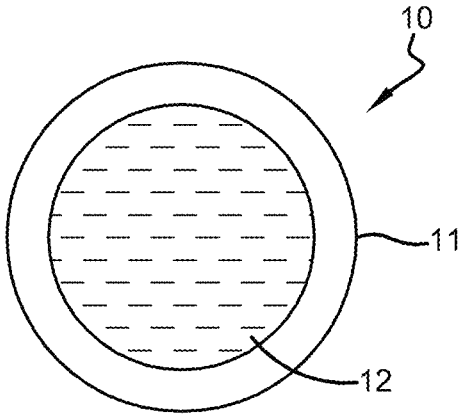

A first embodiment of a tubular structure according to this invention is shown in FIG. 1 and designated by the numeral 10. The tubular structure 10 includes a tube 11 including a rheological fluid 12 in its interior volume. The tube is in the micro- or nanoscale.

Figure 2A:
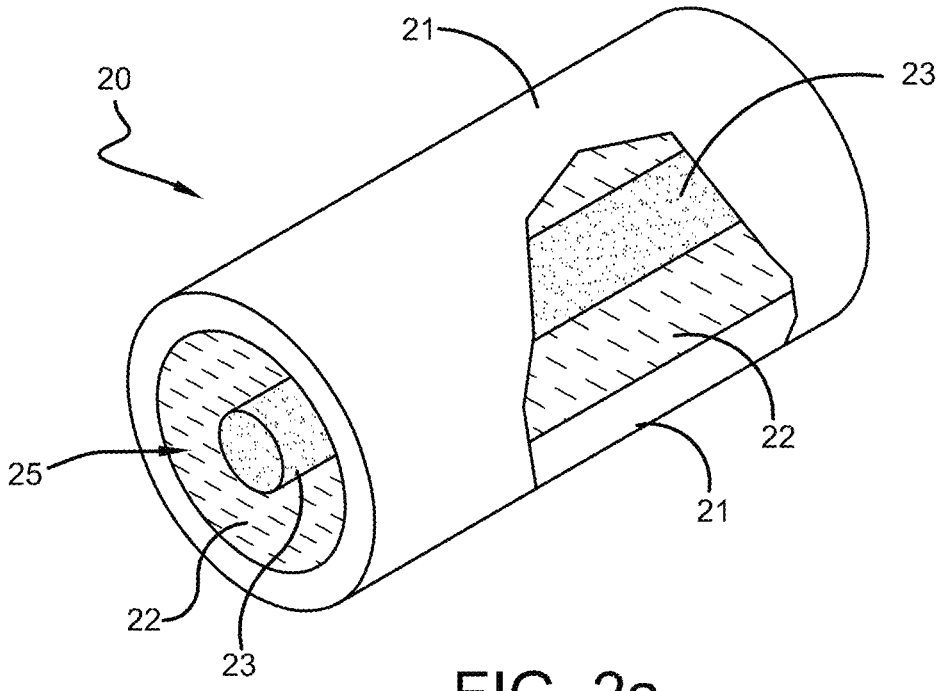
FIG. 2*a* provides a perspective view and FIG. 2*b* provides front elevational view of a core/shell type tubular structure in accordance with this invention.
Figure 2B:
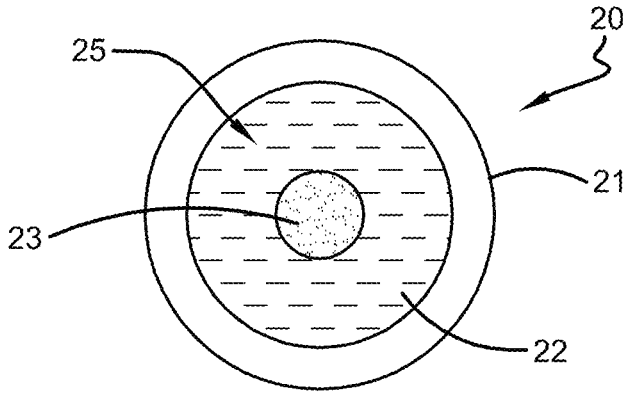

A second embodiment of a tubular structure according to this invention is a core/shell type tubular structure shown in FIG. 2 and designated by the numeral 20. The tubular structure 20 includes an outer tube 21 surrounding an interior core 23 to define an annular space 25 therebetween. A rheological fluid 22 fills the annular space 25. The tube is in the micro- or nanoscale, as is, obviously, the core 23 that must reside therein.

Figure 3A:
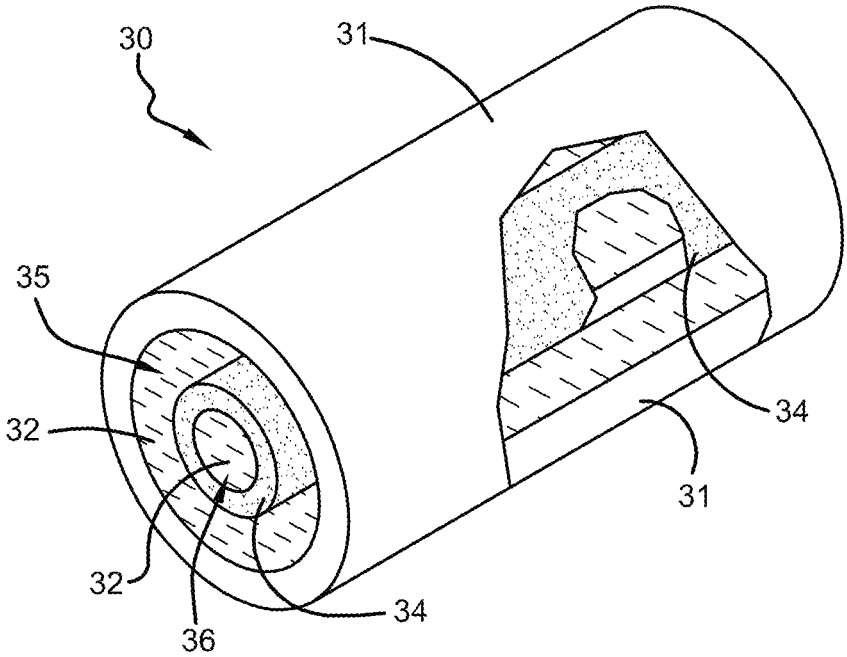
FIG. 3*a* provides a perspective view and FIG. 3*b* provides front elevational view of a concentric tube type tubular structure in accordance with this invention.
Figure 3B:
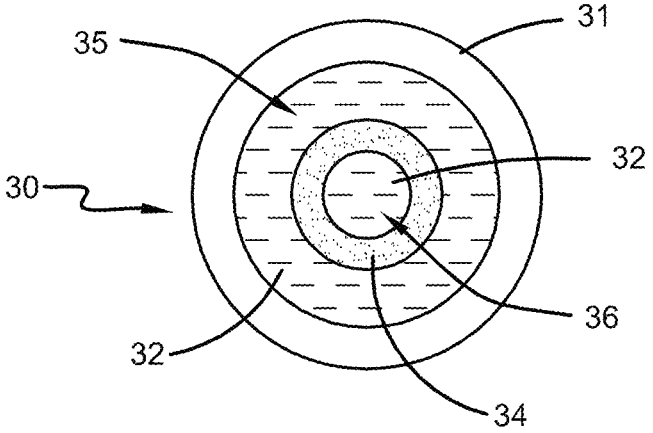

A third embodiment of a tubular structure according to this invention is a concentric tube type tubular structure shown in FIG. 3 and designated by the numeral 30. The tubular structure 30 includes an outer tube 31 and at least one concentric tube 34 in its interior volume. This defines a first annular space 35, between the inner surface of the outer tube 31 and the outer surface of the concentric tube 34, and an axial space 36, at the interior volume of the concentric tube 34. A rheological fluid 32 is present in either the first annular space 35 or the second annular space 36 or both, and if in both, the same or different rheological fluids 32 may fill in each of those spaces 35, 36. The outer tube 31 is in the micro- or nanoscale, as is, obviously, the concentric tube 34. Notably, this embodiment can be practiced with multiple concentric tubes, with or without rheological fluid between each neighboring tube, though rheological fluid is to be present in the tubular structure between at least one set of neighboring tubes.

Figure 4A:
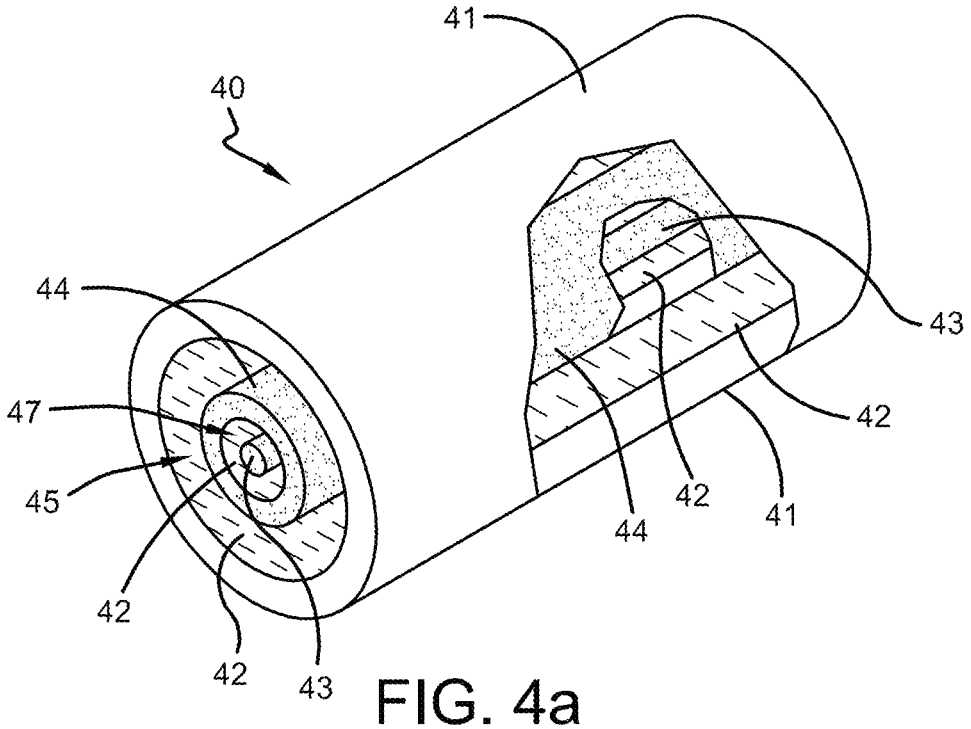
FIG. 4*a* provides a perspective view and FIG. 4*b* provides front elevational view of a core/concentric tube type tubular structure in accordance with this invention.
Figure 4B:
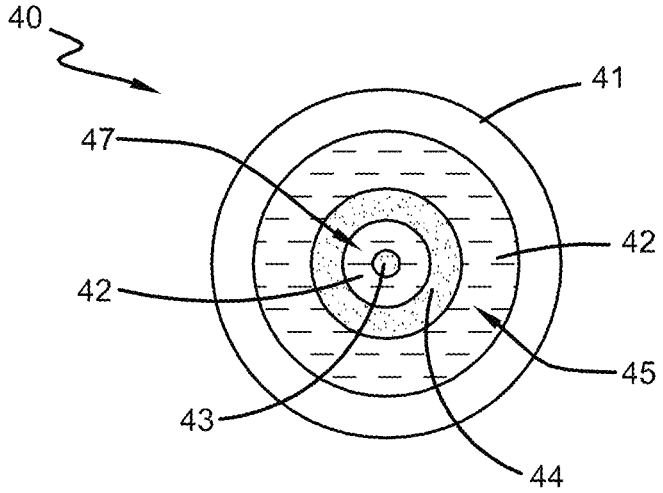

A fourth embodiment of a tubular structure according to this invention is core/concentric tube type tubular structure shown in FIG. 4 and designated by the numeral 40. The tubular structure 40 includes an outer tube 41 having an interior core 43 and at least one concentric tube 44 in its interior volume, between the outer tube 41 and the interior core 43. This defines a first annular space 45, between the inner surface of the outer tube 41 and the outer surface of the concentric tube 44, a second annular space 47, between the inner surface of the concentric tube 44 and the outer surface of the core 43. A rheological fluid 42 is present in either the first annular space 45 or the second annular space 47 or both, and if in both, the same or different rheological fluids 42 may fill in each of those annular spaces 45, 47. The outer tube 41 is in the micro- or nanoscale, as is, obviously, the concentric tube 44 and the interior core 43 that must reside therein. Notably, this embodiment can be practiced with one core and multiple concentric tubes, with or without rheological fluid between each neighboring tube, and with or without rheological fluid between the core and its neighboring tube, though rheological fluid is to be present in the tubular structure between at least one set of neighboring tubes or between the core and its neighboring tube.

In all embodiments disclosed with respect to FIGS. 1-4, at least one of either the tube or core components is made from an electroactive polymer. Because the embodiment of FIG. 1 has only an outer tube 11, that tube is made from an electroactive polymer. In the embodiment of FIG. 2, either the core 23 or the outer tube 21 (shell) or both is made from an electroactive polymer. In the embodiment of FIG. 3, one or more of the concentric tubes—tube 31 or tube 34 in the embodiment shown—is made from an electroactive polymer. In the embodiment of FIG. 4, one or more of the components including the concentric tubes and the core is made from an electroactive polymer.

In some embodiments, the rheological fluid is in contact with at least one component (core or tube) made from an electroactive polymer. In other embodiments, the rheological fluid is held in annular spaces or hollow volumes so as to not be in direct contact with an electroactive polymer.

An electroactive polymer will exhibit a change in size when stimulated by an electrical field. Some electroactive polymers, known as piezoelectric polymers, also conversely generate an electrical charge (or electric polarization) when mechanical stress (e.g., pressure) is applied to the polymers. In the present invention, the generation of an electrical charge upon applied pressure is a particularly desire property, but electroactive polymers that do not exhibit the piezoelectric effect are also useful. The benefits relating to the piezoelectric properties of some polymers will be described more fully below. Suitable piezoelectric polymer may broadly be selected from any polymer exhibiting this property, whether currently existing or hereinafter discovered. It is noted that piezoelectric polymers are the focus of much research in present times such that other specific types of piezoelectric polymer will likely be developed. The processing thereof in accordance with this invention to create the structures herein will be within the level of ordinary skill in the art.

Suitable piezoelectric polymers will include four critical elements that exist for all piezoelectric polymers, regardless of morphology. These essential elements are: (a) the presence of permanent molecular dipoles; (b) the ability to orient or align the molecular dipoles; (c) the ability to sustain this dipole alignment once it is achieved; and (d) the ability of the material to undergo large strains when mechanically stressed. This is known in the art such that suitable piezoelectric polymers can be chosen by those of ordinary skill in the art.

Suitable electroactive polymers may be selected from ferroelectric polymers, dielectric elastomers, electrostrictive graft polymers, liquid crystalline polymers, ionic polymer-metal composites and piezoelectric polymers. The electroactive polymer may also be provided by polymers carrying magnetite and/or ferroelectric nanoparticles. It will be appreciated that some materials fall into more than one of these groups. By way of example, and without being limited hereto, suitable electroactive polymers include polyvinylidene fluoride (PVDF), trifluoroethylene (TrFE), PVDF and TrFE copolymers, PVDF and tetraflouoroethylene copolymers and odd-numbered nylon.

In particular embodiments, the tubular structures are formed through electrospinning the core and tube components, and suitable electroactive polymers are those that are capable of being electrospun.

In particular embodiments the electroactive component is formed of PVDF, and in other embodiments, from PVDF and its copolymers. PVDF and its copolymers are known to provide one of the highest electroactive responses among polymers and present piezoelectricity several times greater than quartz. However, PVDF exhibits many polymorphs. The reason lies behind its simplistic structure, —CH2-CF2-, which lies in between polyethylene (PE) —CH2-CH2-, and polytetrafluoroethylene (PTFE) —CF2-CF2-. As a result, PVDF is highly flexible (close to PE) while having stereochemical constraints (as in PTFE), giving rise to its ability to crystallize in four different polymorphs. In PVDF, both trans (T) and gauche (G) conformations co-exist in a stable state. The chain conformations of PVDF can pack into four ways in a unit cell, which are identified as β, α, δ and γ phases (beta, alpha, delta and gamma). The α-phase crystal, due to its TGTG' conformation and anti-parallel array, is non-polar, while the other phases are polar. Out of the three polar phases, the strongest dipole moment is exhibited by β-phase PVDF crystals due to their all-trans zig-zag conformation, resulting in the ability of the polarization to be switched between opposite but energetically equivalent directions along the b-axis of a unit cell. This allows the β-phase crystal of PVDF to exhibit the strongest piezoelectric response when stimulated, in comparison with other polymorphs of PVDF.

Figure 12:
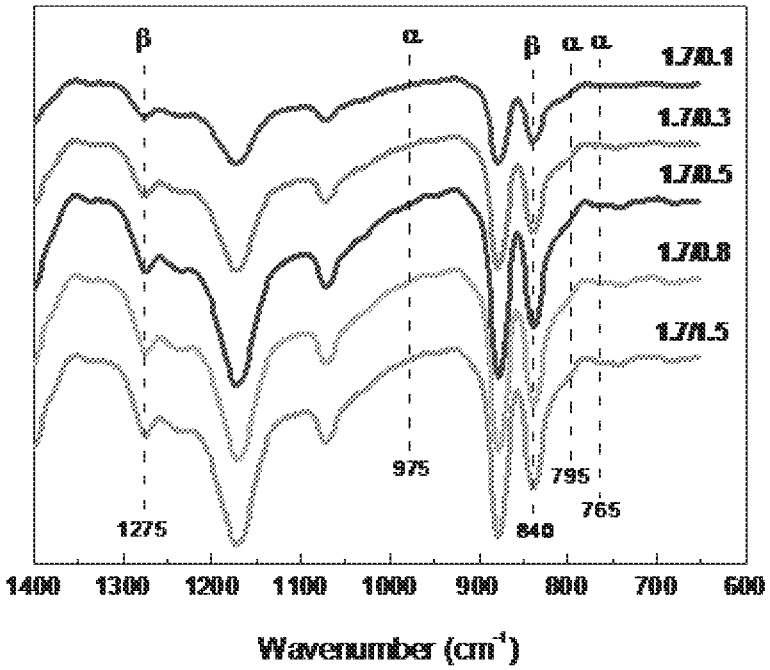
FIG. 12 shows the FTIR spectra.
Figure 13:
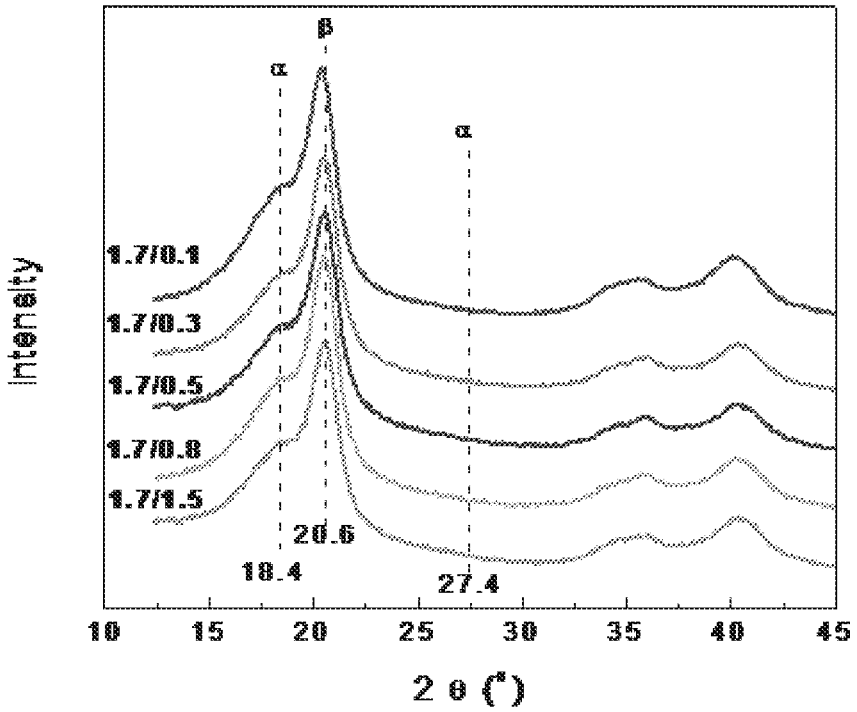
FIG. 13 shows X-ray diffraction data of electrospun PVDF.

Notably, the formation of β-phase crystals are promoted by electrospinning, as evidenced in FIG. 12, which shows the FTIR spectra, and FIG. 13, which shows X-ray diffraction data of electrospun PVDF. Microtubules were prepared by co-axial electrospinning at different core-shell feed rates (as in the Example below) and the results clearly evidence the confinement effects of electrospinning, which readily promotes β-phase crystallization and orientation. Further drawing of fibers, such as using a rotating collector, can enhance the β-phase crystallization, minimizing solvent induced relaxation.

FIG. 12 provides FTIR spectra for PVDF/PVA electrospun microtubules prepared at different feed rates, namely, 1.7/0.1, 1.7/0.3, 1.7/0.5, 1.7/0.8 and 1.7/1.5 mL/h, respectively. The intense peaks at 840 cm−1 and 1275 cm−1 are the characteristic bands of β-type crystallites of PVDF. No observable peaks appear at 975 cm−1, 795 cm−1 and 764 cm−1, which are characteristic of α-type crystallites of PVDF, indicating that α-type PVDF crystal does not appear in co-axial electrospun microtubules. FIG. 13 shows XRD patterns of PVDF in the electrospun microtubules prepared at corresponding shell/core feed rates (mL/h). PVDF show similar crystalline structures including one major peak at 2θ=20.6°, which is characteristic of β-type crystallite. There are no observable peaks at 2θ=18.4° and 27.4° in XRD. The electrospinning enhances the fl-phase crystal and thus enhances piezoelectric response of the spun tube (or spun core).

As noted, the present invention requires that only one tube or core component be formed of an electroactive polymer. In embodiments including components that are not made from electroactive polymers, the non-electroactive components (tubes and/or core) can be formed from virtually any material that can be electrospun into fibers/tubes. Without limitation, such materials include semi-crystalline and amorphous thermoplastic polymers such as nylons, polycaprolactone, polyaniline, polyolefins, polyvinyl alcohol and all electrospinnable polymers.

The rheological fluid may be selected from electrorheological fluids and magnetorheological fluids. Electrorheological (ER) fluids are suspensions of extremely fine non-conducting particles (up to 50 micrometers diameter) in an electrically insulating fluid. The apparent viscosity of these fluids changes reversibly by an order of up to 100,000 in response to an electric field. For example, a typical ER fluid can go from the consistency of a liquid to that of a gel or even solid, and back, with response times on the order of milliseconds.

In particular embodiments, the electro-rheological fluid is a stable electro-rheological suspension consisting of barium titanyl oxalate and other nanoparticles in silicon oil. In particular embodiments, the nanoparticles have an average diameter of 50-70 nm. In other embodiments the nanoparticles have a surface coating of from 3 to 10 nm.

In embodiments employing barium titanyl oxalate nanoparticles, the nanoparticles may be fabricated by first dissolving barium chloride in distilled water at controlled temperatures. Separately, oxalic acid is dissolved in water in an ultrasonic tank, and titanium tetrachloride is slowly added. This forms titanyl oxalate particles with an average diameter of 50-70 nm and a surface coating of about 3 to 10 nm. These nanoparticles are mixed with silicone oil prior to create the electro-rheological fluid.

A magnetorheological fluid (MR fluid) is a type of smart fluid having magnetic nanoparticles in a carrier fluid, usually a type of oil. When subjected to a magnetic field, the apparent viscosity of the fluid greatly increases to the point of becoming a viscoelastic solid. Importantly, the yield stress of the fluid when in its active ("on") state can be controlled very accurately by varying the magnetic field intensity. Notably, the magnetic particles are suspended in the carrier fluid when there is no applied magnetic field, and, when a magnetic field is applied, the particles align themselves along lines of magnetic flux and the aligned particles restrict the movement of the fluid in the direction perpendicular to the direction of flux, effectively increasing its apparent viscosity.

Suitable ER fluids and MR fluids are selected from those having suitably small suspended particles so as to be capable of being retained inside the microscale or nanoscale tubular structures described above. By way of example, and without being limited hereto, suitable ER fluids will include particles selected from barium titanyl oxalate, magnetite and $BiFeO_3$ particles suspended in fluids selected from silicone oil or other suspension fluids.

Figure 5:
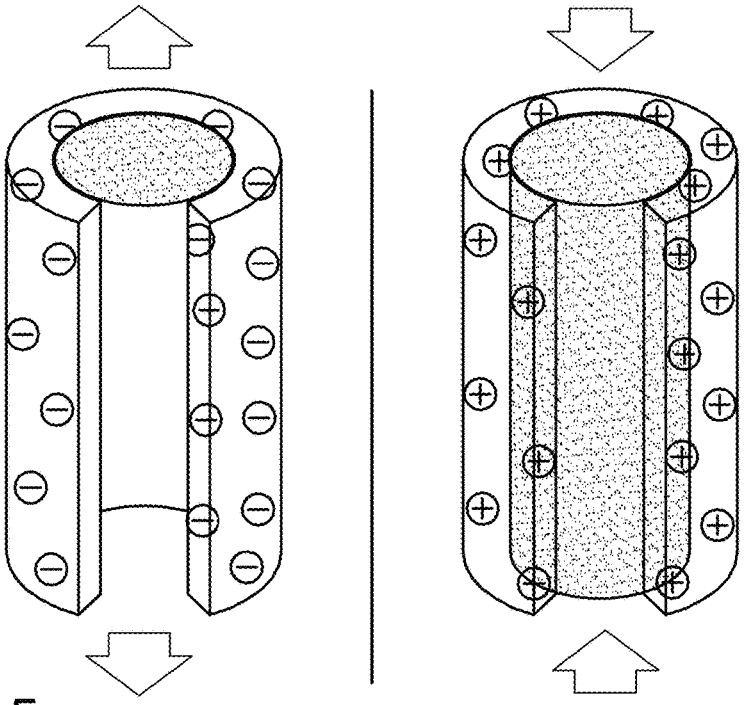
FIG. 5 shows a tubular structure in accordance with FIG. 1 as it reacts to applied loads.

Because the electroactive polymer generates an electrical charge (or electric polarization) when pressure is applied to it, the application of pressure to the tubular structures herein will result in a change in the apparent viscosity of the electro- and magneto-rheological fluids This is generally shown in FIG. 5, using a simple rheologic fluid-filled tube, as in the embodiment of FIG. 1. For purposes of this disclosure relating to FIG. 5, the tube 11 is formed of an electroactive polymer and is filled with an ER fluid 12. The arrows represent the applied pressure. As can be seen, when tension is applied, as at the left-hand side of FIG. 5, the tube 11 bears load, providing high stiffness. The ER fluid 12 contributes frictional force and mechanical toughness. When the tube 11 is under compression, as at the right-hand side of FIG. 5, the ER fluid 12 increases in apparent viscosity, due to the change in polarity of the electroactive polymer forming the tube 11. Some ER fluids will even transform from liquid to solid phase. Regardless whether phase transformation occurs, this apparent viscosity increase provides additional contact stress and stiffness to the overall tubular structure 10. Upon fiber fracture the ER fluid resumes its more fluid state and drains from the tube 11. The cohesive force between the two components, viz. polymer and electro-rheological solid, provides simultaneous compressive stiffness and frictional damping.

Figure 6:
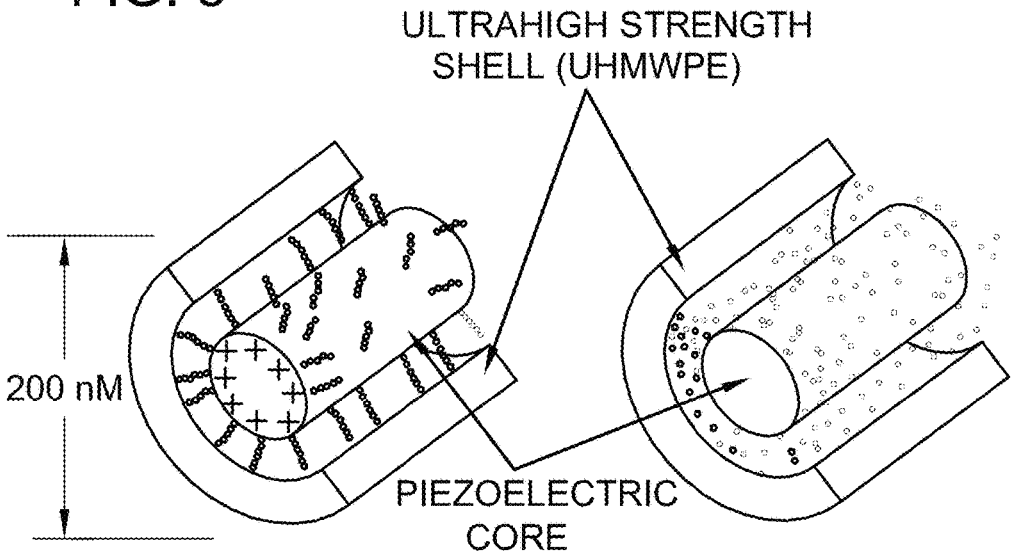
FIG. 6 shows a tubular structure in accordance with FIG. 2 as it reacts to applied loads.

In FIG. 6, another example of the effect of external pressure on the tubular structures herein is shown using a core/shell structure as in the embodiment of FIG. 2. For purposes of this disclosure relating to FIG. 6, the tube 21 is formed of an ultra high molecular weight polyethylene (UHMWPE), while the core 23 is formed from an electroactive polymer and is filled with an ER fluid 22. FIG. 6 schematically depicts the reaction of such a tubular structure to an impact, such as the impact of a bullet. When the tubular structure is impacted, the electroactive polymer core 23 becomes charged, causing the suspended particles in the ER fluid to percolate and the apparent viscosity of the ER fluid increases, and change phases from liquid to solid phases. As the projectile impact ends or is removed, as shown at the right-hand side of FIG. 6, the core is no longer charged, and the particles of the ER fluid relax out of alignment and back into a normal suspension.

From the foregoing examples it will be appreciated that similar effects will be appreciated from the practice of tubular structures of the embodiments of FIGS. 3 and 4. It should also be appreciated that more than one core or tube component could be formed from an electroactive polymer, and rheological fluid may be present in one or more annular spaces defined between neighboring tubes or a tube and a core. When rheological fluid fills multiple annular spaces, the rheological fluids may be the same or different.

The same effects will be achieved by the use of a magnetorheological fluid. Additionally, embodiments employing magnetorheological fluids would react to applied electro-magnetic fields.

Notably, different chemical coatings can be applied to the nanoparticles of the electro-rheological and magneto-rheological fluids to enhance the electro-rheological and magneto-rheological effects of the suspensions and thus delay and increase the speed of apparent viscosity transitions such that the fluids can either form the core of co-axially spun fibers or be intercalated between concentric shells.

These tubular structures will have many applications. Just a few applications include dry adhesive fabrics, protective fabrics (e.g., ballistic resistant; bulletproof fabrics), synthetic muscle fibers, sensors and actuators, nerve conduits and blood capillaries.

For example, for protective fabrics, the tubular structures above can be formed into nonwoven fabrics, which is common in electrospinning, and the fabric can be used to protect surface, including living beings.

Regarding dry adhesive fabrics, it is now known that microscale and nanoscale fibers and tubes exhibit dry adhesion to surfaces. It is believed the adhesion results from at least two factors. First, physical surfaces, even smooth and polished surfaces, contain asperities, and the tips of the fibers/tubes and the thickness of the sidewalls thereof are small enough to interact with the depressions and projections of the surface to increase grip. Second, van der Waals forces between the surface and the fibers/tubes significantly drive the dry adhesion. Notably, the molecular orientation and crystallinity of electrospun fibers/tubes leads to an improved generation of the intermolecular forces that contribute to van der Waals interaction. This attractive force might be beneficially employed by the creation of nonwoven fabrics that could be used to adhere items, and even to create suits that one could wear and climb walls much like geckos or spiders or flies. It is believe that the use of the rheological fluid (filling the tubular structure that would form the nonwoven fabric) will increase the functionality by providing pressure sensitive stiffness response, meaning that the fabric, due to the apparent viscosity change of the rheological fluid will stiffen as pressure is applied to press the fabric to the surface, then relaxing as that pressure is release. For a wall climbing application, wherein an individual would wear gloves and shoes of such nonwoven fabric, the pressure response would be beneficial in that the material will stiffen and strengthen as a hand or foot is pressed to the wall, increasing the grip, and would relax and lessen the grip as the hand or foot pulled away from the wall.

Figure 7:
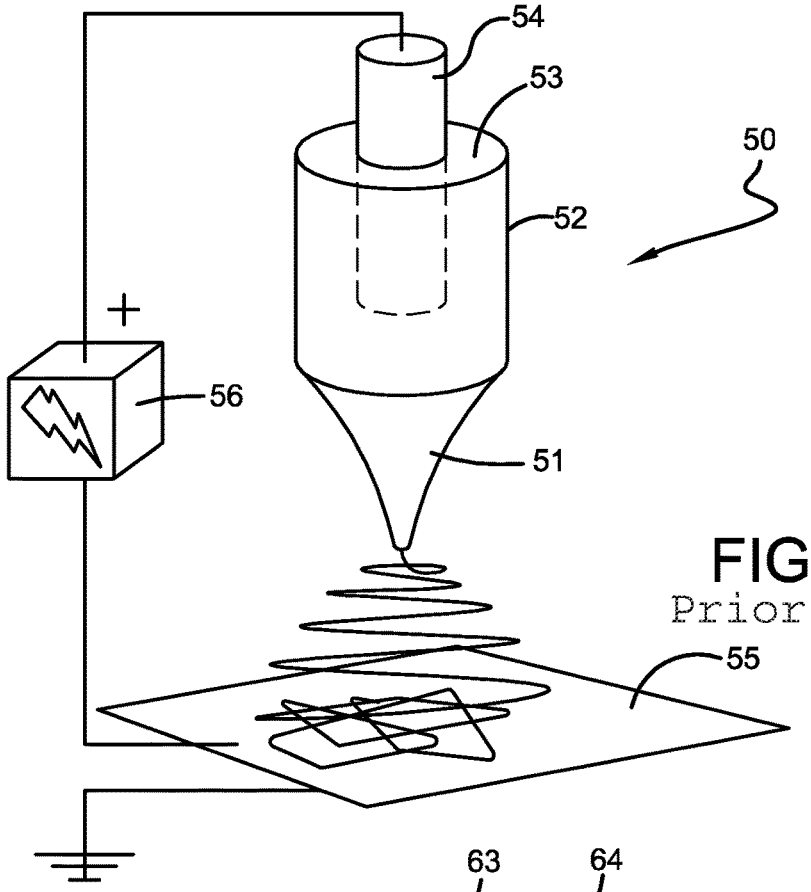
FIG. 7 Prior Art
FIG. 7 shows a general schematic of an electrospinning process.

The tubular structures of this invention are formed through electrospinning. The general electrospinning apparatus is shown in FIG. 7, and the general apparatus and process are well known. The present invention alters the prior apparatus and process by the introduction of new spinnerets and concepts for the creation of the tubular structures of FIGS. 1-4. The general electrospinning apparatus and process is shown in FIG. 7 and designated by the numeral 50. Apparatus 50 includes a spinneret 51 that communicates with a container 52 holding spinning fluid 53, which is charged as by an electrode 54 and power source 56. The spinneret 51 is generally oriented to point toward a grounded collector 55. The spinning fluid 53 is advanced, by gravity or pressure, to the tip of the spinneret 51, and forms a droplet. When a sufficiently high voltage is applied to the spinning fluid 52, electrostatic repulsion counteracts the surface tension and the droplet is stretched. At a critical point, a stream of the spinning fluid 53 erupts from the droplet, and is drawn to the collector 55 where is it collected as a spun fiber or tube.

Some embodiments of the present invention are directed to improvements to the general electrospinning apparatus and method. Particularly, the present invention provides spinnerets and processes for the creation of the more complex tubular structures shown herein.

Figure 8:
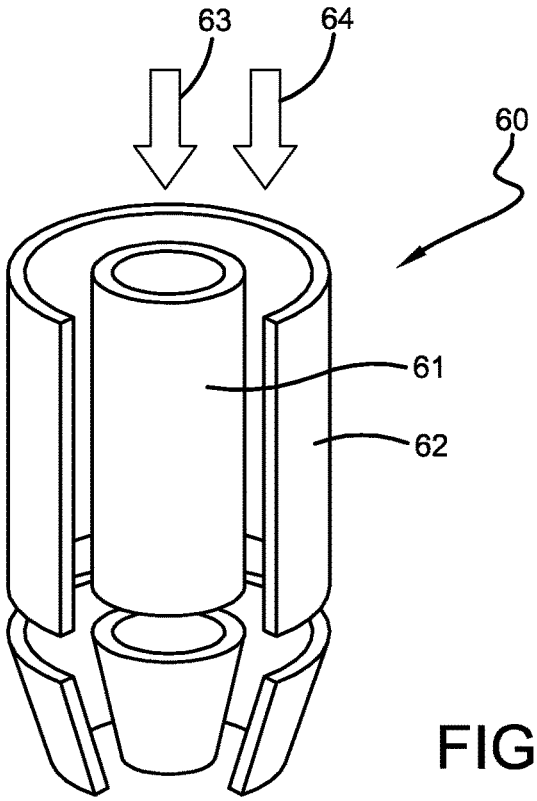
FIG. 8 shows a first spinneret in accordance with this invention and suitable for creating tubular structures in accordance with the embodiment of FIG. 1.

Referring now to FIG. 8, a spinneret 60 is shown. This spinneret 60 is a coaxial spinneret, suitable for the creation of tubular structure of FIG. 1. The spinneret 60 includes a central spinning needle 61 and an outer spinning needle 62. The central spinning needle 61 includes central passage 63, and an annular passage 64 is defined between the outer surface of the central spinning needle 61 and the inner surface of the outer spinning needle 62.

To form the single tubular structure 10 of FIG. 1, a tube-forming material is fed to the annular passage 64, while a hollow-forming material or rheological fluid is fed to the central passage 63 and are electrospun together. By "tube-forming material" it is meant that this material ultimately forms a tube, particularly, in this embodiment a tube 11. By "hollow-forming" material it is meant that the material ultimately is fully or partially removed from the electrospun composite or is otherwise caused to undergo a change so as to leave behind a hollow interior. When employed, the hollow-forming material is ultimately removed or undergoes gelled interface formation so that the tube 11 is hollow. The hollow tube 11 would then be filled with rheological fluid 12. In other embodiments, the rheological fluid is fed to the central passage 63 and electrospun along with the tube-forming material in the annular passage 64, thus forming tubular structure 10 more directly.

The tube-forming material used to form tubular structures such as tubular structure 10 is an electroactive polymer as described above. In some embodiments, the hollow-forming material is an evaporative solvent or solvent extractable material to be removed by evaporation or solvent extraction after spinning. In other embodiments, the hollow-forming material is a material that forms a gelled interface with the tube-forming material (here electroactive polymer) to phase separate and create a hollow center or annular channel, as described in the Example section herein.

Figure 9:
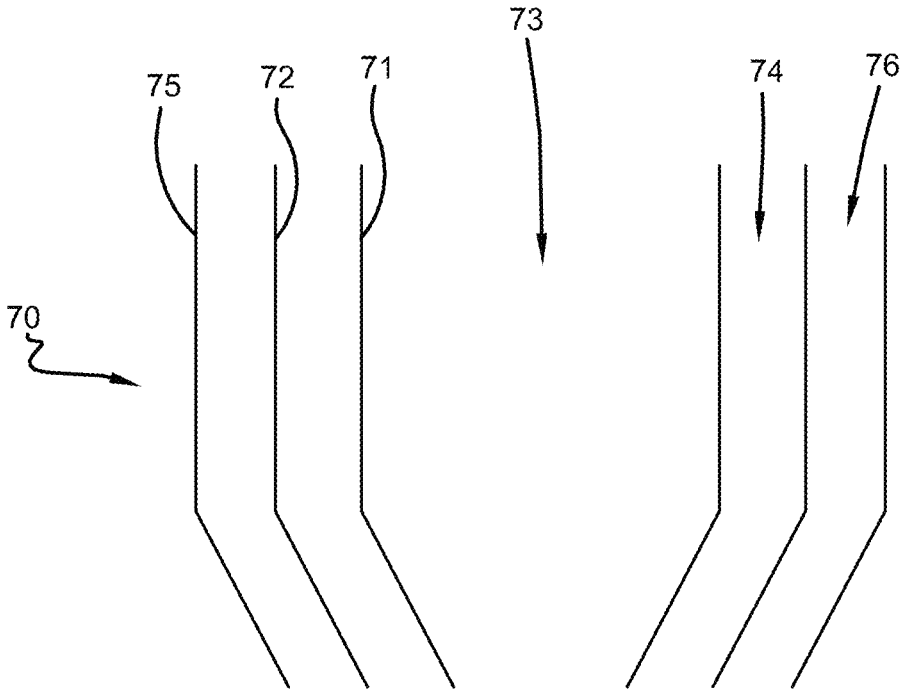
FIG. 9 shows a first spinneret in accordance with this invention and suitable for creating tubular structures in accordance with the embodiment of FIG. 2.

Referring now to FIG. 9, a spinneret 70 is shown. This spinneret 70 is a termed herein a multi-annular spinneret, because it defines multiple annular passages suitable for the creation of core/shell tubular structures such as those of FIG. 2. The spinneret 70 includes a central spinning needle 71, surrounded by an intermediate spinning needle 72. The central spinning needle 71 includes a central passage 73, and an inner annular passage 74 is defined between the outer surface of the central spinning needle 71 and the inner surface of the intermediate spinning needle 72. The spinneret 70 further includes an outer spinning needle 75 surrounding the intermediate spinning needle 72 such that an outer annular passage 76 is defined between the outer surface of the intermediate spinning needle 72 and the inner surface of the outer spinning needle 75.

To form the core/shell tubular structure 20 of FIG. 2, a tube-forming material is fed to the outer annular passage 76, while a hollow-forming material or rheological fluid is fed to the inner annular passage 74, and a core-forming material is fed to the central passage 73, and all are electrospun together. By "core forming material" it is meant that this material ultimately forms a physical core structure, particularly, in this embodiment, a core 23. When the hollow-forming material is employed, the annular space 25 defined between the core 23 (spun from the central passage 73) and the tube 21 (i.e., shell; spun from the outer annular passage 76) will be hollow (upon extraction or evaporation or phase inversion of the material fed to the inner annular passage 74) and this annular space 25 would then be filled with rheological fluid 22. In other embodiments, the rheological fluid is fed to the inner annular passage 74 and electrospun along with the core-forming material in the central passage 73 and the tube-forming material in the outer annular passage 76, thus forming tubular structure 20 more directly.

In this embodiment either one or both of the tube-forming material and core-forming material is an electroactive polymer as described above. In some embodiments, the hollow-forming material, if employed, is an evaporative solvent or solvent extractable material to be removed by evaporation or solvent extraction after spinning. In other embodiments, the hollow-forming material, if employed, is a material that forms a gelled interface with the tube-forming material (here electroactive polymer) to phase separate and create a hollow center or annular channel, as described in the Example section herein.

Figure 10:
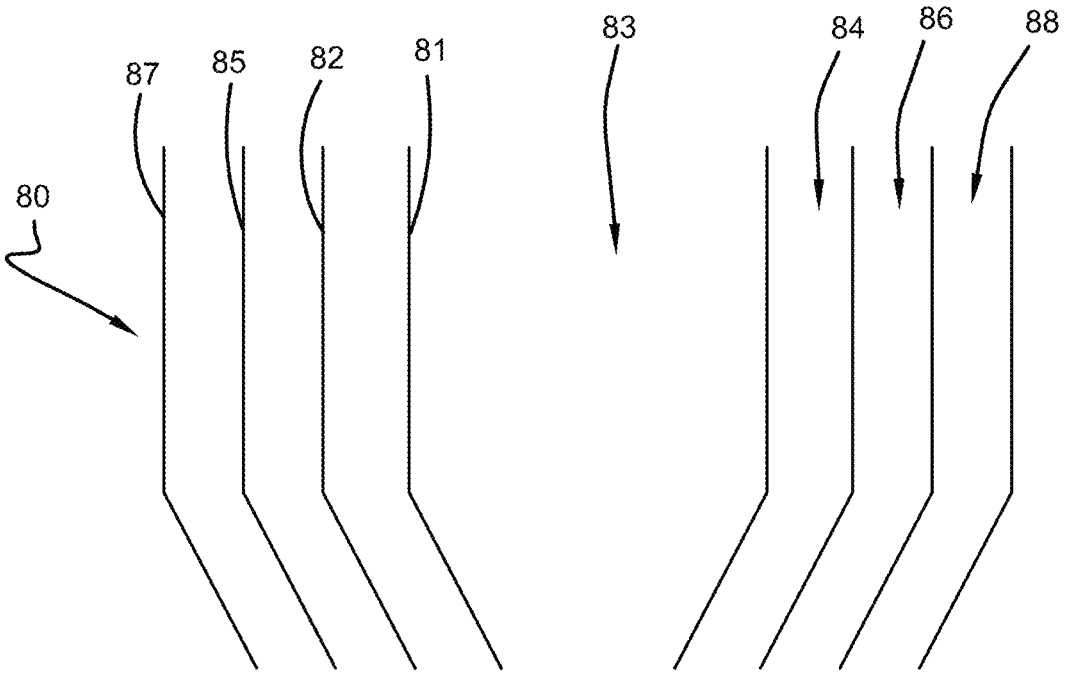
FIG. 10 shows a first spinneret in accordance with this invention and suitable for creating tubular structures in accordance with the embodiment of FIG. 3.

Referring now to FIG. 10, a spinneret 80 is shown. This spinneret 80 is a termed herein a multi-annular spinneret, because it defines multiple annular passages suitable for the creation of concentric shell type tubular structures such as those of FIG. 3. The spinneret 80 includes a central spinning needle 81, surrounded by a first intermediate spinning needle 82. The central spinning needle 81 includes a central passage 83, and an inner annular passage 84 is defined between the outer surface of the central spinning needle 81 and the inner surface of a first intermediate spinning needle 82. The spinneret 80 further includes an second intermediate spinning needle 85 surrounding the first intermediate spinning needle 82 such that an intermediate annular passage 86 is defined between the outer surface of the first intermediate spinning needle 82 and the inner surface of the second intermediate spinning needle 85. An outer spinning needle 87 surrounds the second intermediate spinning needle 85 to define an outer annular passage 88 between the outer surface of the second intermediate spinning needle 85 and the inner surface of the outer spinning needle 87.

To form the concentric tube type tubular structure 30 of FIG. 3, a tube-forming material is fed to the outer annular passage 88 and the inner annular passage 84, while a hollow-forming material or rheological fluid is fed to the intermediate annular passage 86 and the central passage 83, and all are electrospun together. When the hollow-forming material is employed, the annular space 35 defined between the outer tube 31 (spun from the outer annular passage 88) and the concentric tube 34 (spun from the inner annular passage 84) will be hollow (upon extraction or evaporation or phase inversion of the material fed to the inner annular passage 84) and this annular space 35 would then be filled with rheological fluid 32. In other embodiments, the rheological fluid is fed to the intermediate annular passage 86 or the central passage 83 or both, and is electrospun along with the tube-forming material in the outer annular passage 88 and the inner annular passage 84, thus forming tubular structure 30 more directly.

In this embodiment either one or both of the tube-forming materials is an electroactive polymer as described above. In some embodiments, the hollow-forming material, if employed, is an evaporative solvent or solvent extractable material to be removed by evaporation or solvent extraction after spinning. In other embodiments, the hollow-forming material, if employed, is a material that forms a gelled interface with the tube-forming material (here electroactive polymer) to phase separate and create a hollow center or annular channel, as described in the Example section herein.

Figure 11:
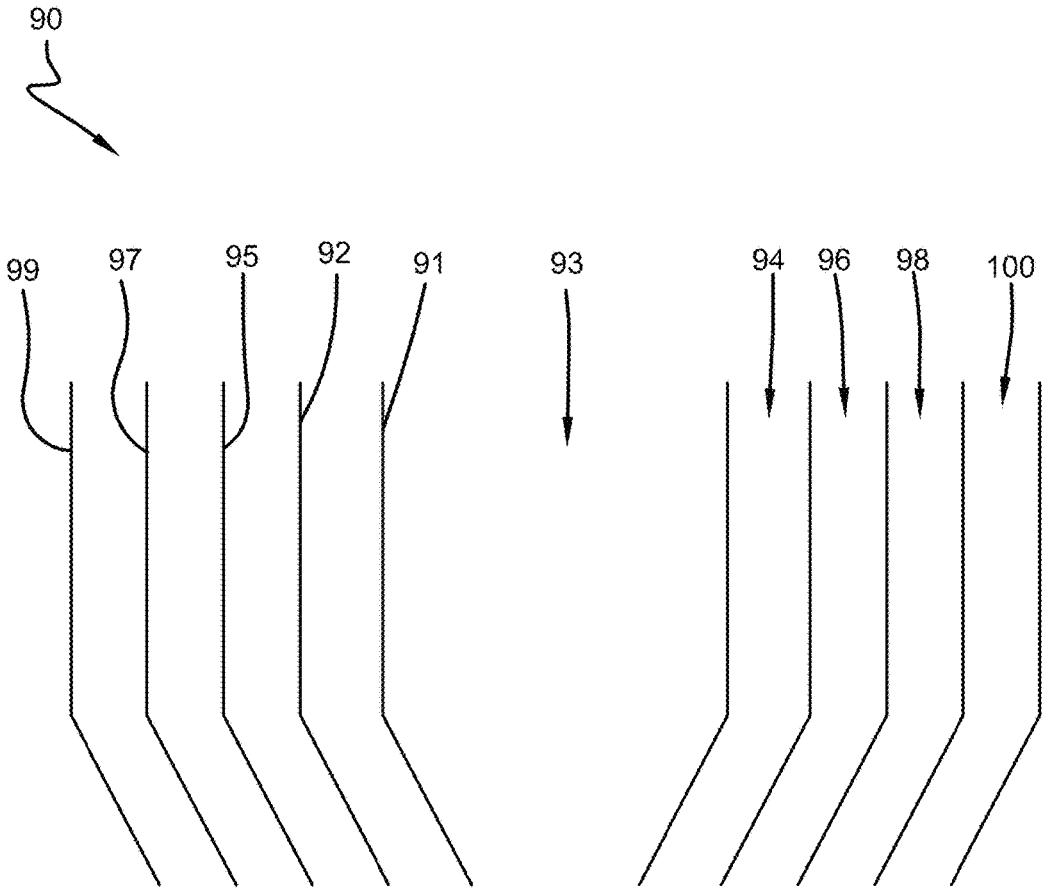
FIG. 11 shows a first spinneret in accordance with this invention and suitable for creating tubular structures in accordance with the embodiment of FIG. 4.

Referring now to FIG. 11, a spinneret 90 is shown. This spinneret 90 is a termed herein a multi-annular spinneret, because it defines multiple annular passages suitable for the creation of core/concentric shell type tubular structures such as those of FIG. 4. The spinneret 90 includes a central spinning needle 91, surrounded by a first intermediate spinning needle 92. The central spinning needle 91 includes a central passage 93, and an inner annular passage 94 is defined between the outer surface of the central spinning needle 91 and the inner surface of the first intermediate spinning needle 92. The spinneret 90 further includes an second intermediate spinning needle 95 surrounding the first intermediate spinning needle 92 such that an first intermediate annular passage 96 is defined between the outer surface of the first intermediate spinning needle 92 and the inner surface of the second intermediate spinning needle 95. A third intermediate spinning needle 97 surrounds the second intermediate spinning needle 95 to define a second intermediate annular passage 98 between the outer surface of the second intermediate spinning needle 95 and the inner surface of the third intermediate spinning needle 97. An outer spinning needle 99 surrounds the third intermediate spinning needle 97 to define an outer annular passage 100 between the outer surface of the third intermediate spinning needle 97 and the inner surface of the outer spinning needle 99.

To form the core/concentric tube type tubular structure 40 of FIG. 4, a tube-forming material is fed to the outer annular passage 10 and the first intermediate annular passage 96, while a hollow-forming material or rheological fluid is fed to the second intermediate annular passage 98 and the inner annular passage 94. A core-forming material is fed to the central passage 93. All materials are electrospun together. When the hollow-forming material is employed, the annular space 45 defined between the outer tube 41 (spun from the outer annular passage 100) and the concentric tube 44 (spun from the first intermediate annular passage 96) will be hollow (upon extraction or evaporation or phase inversion of the material fed to the second intermediate annular passage 98) and this annular space 45 would then be filled with rheological fluid 42. Similarly, when the hollow-forming material is employed, the annular space 47 defined between the core 43 (spun from the central passage 93) and the concentric tube 44 (spun from the first intermediate annular passage 96) will be hollow (upon extraction or evaporation or phase inversion of the material fed to the inner annular passage 94) and this annular space 47 would then be filled with rheological fluid 42. In other embodiments, the rheological fluid is fed to the second intermediate annular passage 98 or the inner annular passage 94 or both, and is electrospun along with the tube-forming material in the outer annular passage 88 and the inner annular passage 84, thus forming tubular structure 30 more directly.

In this embodiment at least one of the materials selected from the tube-forming materials and core-forming material is an electroactive polymer as described above. In some embodiments, the hollow-forming material, if employed, is an evaporative solvent or solvent extractable material to be removed by evaporation or solvent extraction after spinning. In other embodiments, the hollow-forming material, if employed, is a material that forms a gelled interface with the tube-forming material (here electroactive polymer) to phase separate and create a hollow center or annular channel, as described in the Example section herein.

The various tubular structures of FIGS. 1-4 can wick rheological fluid therein by capillary action, simply by dipping an open end of the tubular structure into the rheological fluid. Is some embodiments, and outer tube of the tubular structure could be made of a material that allows the rheological fluid to diffuse into the tubular structure. Thus, in accordance with one method herein, after formation of the tubular structures, the rheological fluid is wicked into the tubular structures by capillary action. In another method, after formation of the tubular structures, the rheological fluid is diffused through the wall of a tube component.

In a particular embodiment, the present invention provides a tubular structure such as that of FIG. 1, wherein the outer tube 11 is a polyvinylidenedifluoride (PVDF), and the rheological fluid is an electro-rheological fluid. In another embodiment, the present invention provides a tubular structure such as that of FIG. 1, wherein the outer tube 11 is formed of a PVDF/polyvinylalcohol mixture (PVDF/PVA). In a particular embodiment, the outer tube 11 is (PVDF/PVA) and the rheological fluid is a suspension of barium titanyl oxalate nanoparticles suspended in silicone oil.

EXAMPLES

In this example, a coaxial electrospinning methodology is used to fabricate microtubules. This technique makes use of a phase inversion process, which differs from other current microtube and nanotube electrospinning approaches such as using (a) liquid-carrying precursors and (b) core/shell precursors, and presents a viable route to controlling wall thickness of the resulting tubular structures. Prior method (a) mixes polymer solution with mineral and olive oils and forms an electrospun structure having a central component intimately surrounded by and in contact with a shell component, such that, to create a tube, additional treatments are required to remove the central component. This central component is often known as a "core" component, but the term "core" is avoided here so as not to be confused with the "core" components described in the embodiments of FIGS. 1-4. These treatments might include vacuum drying and solvent extraction. Prior method (b) forms a similar electrospun structure through one-step co-axial electrospinning, but the solidified polymer in the center needs to be removed to obtain hollow fibers. The removal steps include solvent extraction and calcination.

The present phase inversion does not require additional treatments. It uses two incompatible polymer solutions: central and shell solutions, respectively in coaxial electrospinning. When the two polymer solutions contact each other, the incompatibility will induce polymer to precipitate a gelled interface between the two solutions. The gelled interface only produces limited contraction under the stretch of the electric force. With the evaporation of the solvents, both the central and shell polymers coagulate at the gelled interface to form a hollow fiber directly in a single-step coaxial electrospinning.

In this example, water (H2O) is used to prevent secondary erosion caused by solvent trapping. Poly(vinylidene fluoride)/poly(vinyl alcohol) (PVDF/PVA) microtubules are prepared to be followed by H2O treatment. Crystallinity and the form of PVDF crystallization are examined using FTIR and XRD techniques. The resulting microtubules are tested by a wicking experiment, which presents evidence for capillary action and potential for micro-actuation and energy transduction.

Materials

PVDF (Kynar 761, Arkema), PVA (87-89% hydrolyzed, Mw=31-50 k, Aldrich) are used as received. DMSO, acetone and ethanol at reagent grade are purchased from Fisher Scientific. Silicone oil (Density 0.960) was obtained from Acros Organics. All the solvents are used without additional treatments.

Co-Axial Electrospinning

PVDF and PVA solutions are used as the shell and central liquids in coaxial electrospinning, respectively. PVDF solution is prepared at the concentration of 0.17 g/mL by dissolving PVDF powder in a mixture of DMSO and acetone (4:6, v/v) at 40-50° C. for 2 h. PVA is dissolved at 0.19 g/mL in a mixture of DMSO and ethanol (9:1, v/v) at 70-80° C. until a clear solution is obtained.

Figure 14:
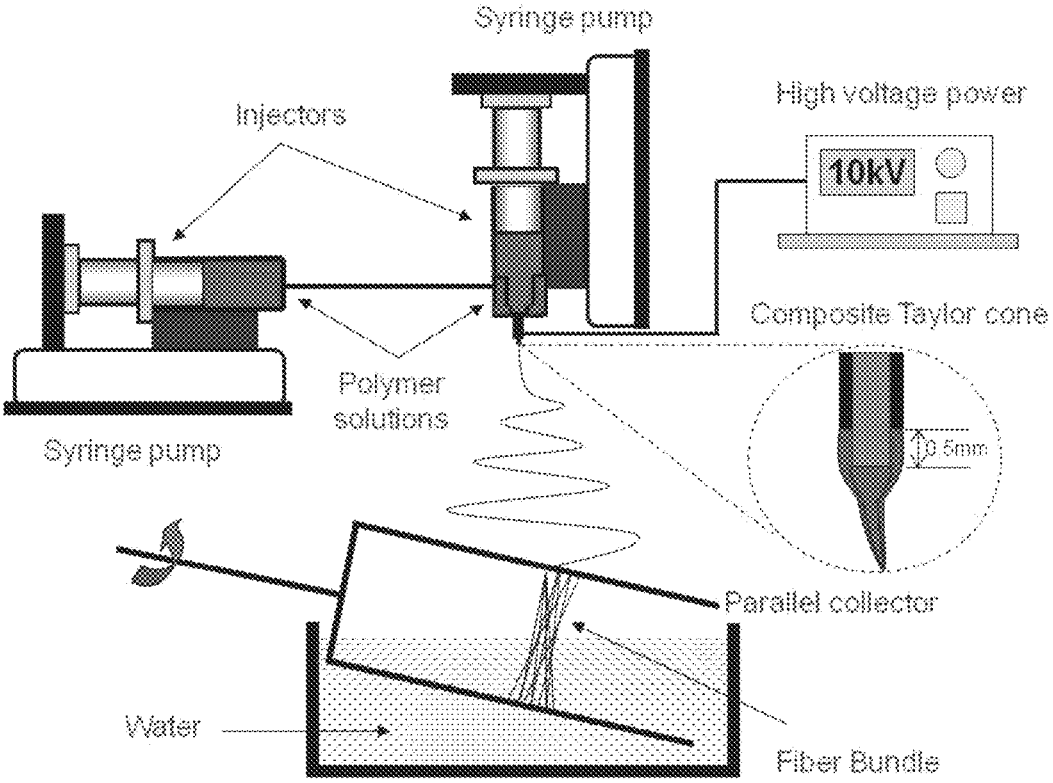
FIG. 14 is a schematic view of a co-axial electrospinning apparatus.

A general schematic representation of the co-axial electrospinning apparatus is shown in FIG. 14 and designated by the numeral 110. The spinneret 160 for the apparatus 110 is similar to that of spinneret 60 of FIG. 8 so like numerals are used for the spinneret though increased by 100. The PVDF solution is fed to the annular passage 164 by pump 112, and the PVA solution is independently fed to the central passage 163 by a pump 114. The co-axial spinneret 160 consists of two concentric needles. The exterior needle 162 has an inner diameter of 1.3 mm. The interior needle 161 has an inner diameter of 0.55 mm, and, in distinction to the spinneret of FIG. 8, the interior needle 161 is set to be 0.5 mm longer than the exterior needle 162, i.e., it extends beyond the end of the exterior needle by 0.5 mm.

The pumps 112, 114 control the feed rates. Coaxial electrospinning is performed with varied central and shell material feed rates. The feed rate of central solution varies from 0.1 mL/h to 1.5 mL/h and shell feed rate is kept at 1.7 mL/h. A custom-made rotatable collector 116 formed of two spaced metal tines 117 and 118 is used to collect microtubules spun from the spinneret 160. The distance between the two metal tines is 9 cm in this example. During electrospinning, the rotating speed is controlled at 60 revolutions per minute (rpm). Voltage is applied to the spinneret by a power source 120, and the voltage is kept at a constant of 10 kV Distance between spinneret and collector is 6-7 cm. The tines 117 and 118 rotate through an H2O bath 122, which is utilized to assist coagulating PVDF/PVA microtubules. The collected fiber bundles 124 are soaked into H2O for more than 24 h to wash away the residual solvents. All the experiments operate at room temperature.

Scanning Electron Microscopy (SEM) Characterization

PVDF/PVA microtubules are soaked in liquid nitrogen for 15 min, and then cut by a fresh scalpel in order to observe the cross section by SEM (Quanta 200, FEI). All SEM samples are coated by silver using a sputter coater (K575x, Emitech) for 1.5 min at 55 A.

Crystallization of PVDF

Crystallization temperature of PVDF (Kynar 761) is known to be around 140-150° C. PVA could be completely dissolved into water at 70° C. in a very short time. In order to investigate the crystallinity of PVDF in PVDF/PVA microtubules, the tubes are immersed in H2O at 60-70° C. for 30 min to wash PVA away and dried in a vacuum oven at 70° C. for 12 h prior to DSC, XRD, and FTIR analyses. DSC measurements are performed in a TA 2920 thermal analysis machine from 25° C. to 250° C. with the heating rate at 10° C./min. Sample weight is 5-6 mg. The melting temperature (Tm) is noted as the temperature at the maximum value of the endothermic peak. And the crystallinity of the PVDF is determined by comparing the melting energy ($\Delta Hm$) to 104.7 J/g, which is the latent heat of fusion of 100% PVDF crystals. XRD patterns of microtubules are obtained from an X-ray diffractometer (AXS D8 Discovery, Bruker) with Cu Ka radiation ($\lambda$=1.5405 nm). The samples are scanned in the range of $2\theta$=10-45° at room temperature. For FTIR (Nicolet 380) measurements, the samples are placed on top of an attenuated total reflection set and scanned from 650 to 4000 $cm^{-1}$.

Capillary Action

PVDF/PVA microtubule is mounted on a glass slide. One end of the tube is shown standing on silicone oil and the other end left open in the air. Optical microscope (Digi Phase Micromaster, Fisher Scientific) is used to observe silicone oil wicking through the middle of the tube. The wicking rate is calculated by measuring the progress of the meniscus, indicating the flow front of silicone oil in PVDF/PVA as a function of time.

Results and Discussion

Fabrication of PVDF/PVA Microtubules

In coaxial electrospinning, polymer solutions are held at the end of the coaxial needles by surface tension. As the voltage applied to the solutions increases, the electric field strength overcomes the surface tension and a cone begins to form with convex sides and a round tip. This is known in literature as the Taylor cone. Coaxial electrospinning consists of central and shell solutions. Central and shell solutions are delivered independently through co-axial needles and are only in contact transiently in the Taylor cone during electrospinning. In this study, the central solution is PVA dissolved in a mixture of DMSO and ethanol, and the shell solution is PVDF dissolved in acetone/DMSO. Due to incompatibility between ethanol and PVDF, the ethanol mixed in PVA solution becomes moderately immiscible with PVDF. When PVA solution contacts PVDF in a Taylor cone, it produces a phase inversion effect. The PVDF thus forms a gelled interface with ethanol. Under a high potential difference, the central solution, the shell solution and the gelled interface between these two solutions forms an electrospun jet and ceaselessly ejects from the Taylor cone's tip. As the solvent evaporates, PVDF solution precipitates from the outside at the interface. PVA from the inside could wet the gelled interface, so it deposits on the inside of the interface. Hollow structure can be directly produced in a single-step coaxial electrospinning. Given equivalent wettability between PVDF and PVA, Zussman and coworkers demonstrated this technique to produce hollow polycaprolactone (PCL)/PVA fibers in single-step coaxial electrospinning.

Figure 15A:
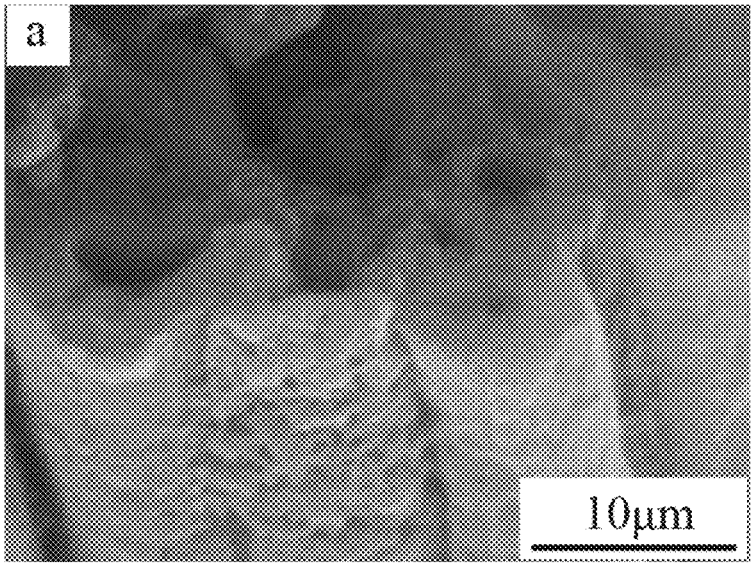
FIGS. 15(*a*), 15(*b*), 16(*a*) and 16(*b*) show scanning electron microscope (SEM) images of PVDF/PVA nanotubes.
Figure 15B:
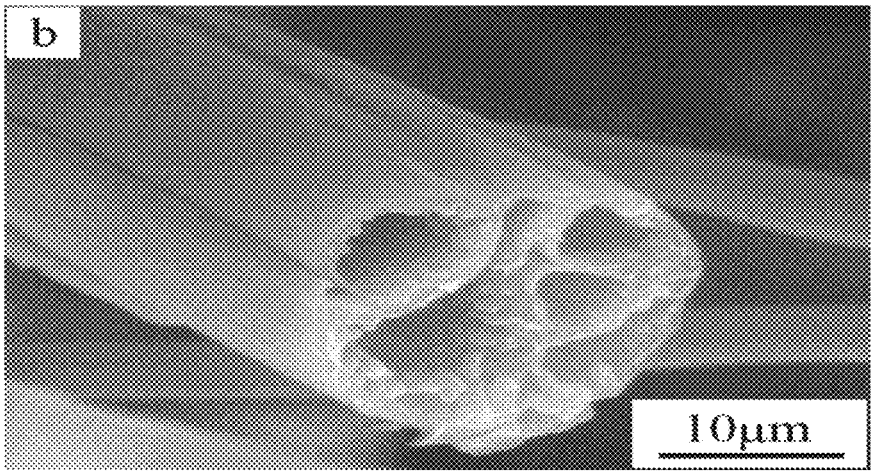

FIG. 15(*a*) shows the PVDF/PVA microtubules. The formation of microtubules is attributed to an inner polymer deposited as a thin adherent film onto the outside polymer wall during evaporation of the central component. Nevertheless, some residual DMSO intercalates between PVDF and PVA solutions. The high boiling point of DMSO renders it difficult to evaporate completely during electrospinning. The residual DMSO gradually penetrates into the surface and corrodes the PVDF wall. The corrosion process results in pits on fiber surfaces in fused PVDF/PVA microtubules, as seen in FIG. 15(*a*). Replacing the solvent with one that exhibits a lower boiling point or increasing the processing temperature can speed up the evaporation and enhance surface smoothness. Uniform fiber surface ensues. In this paper, we use a convection oven to boost evaporation of solvents. Clearly, this method mitigates the erosion of the PVDF/PVA walls. It enhances surface smoothness. Some microtubules can still be seen fused together as shown in FIG. 15(*b*).

Figure 16A:
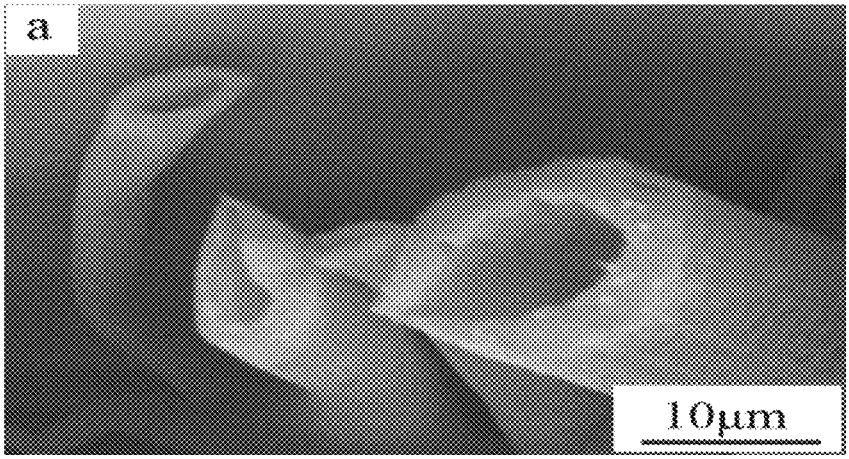
Figure 16B:
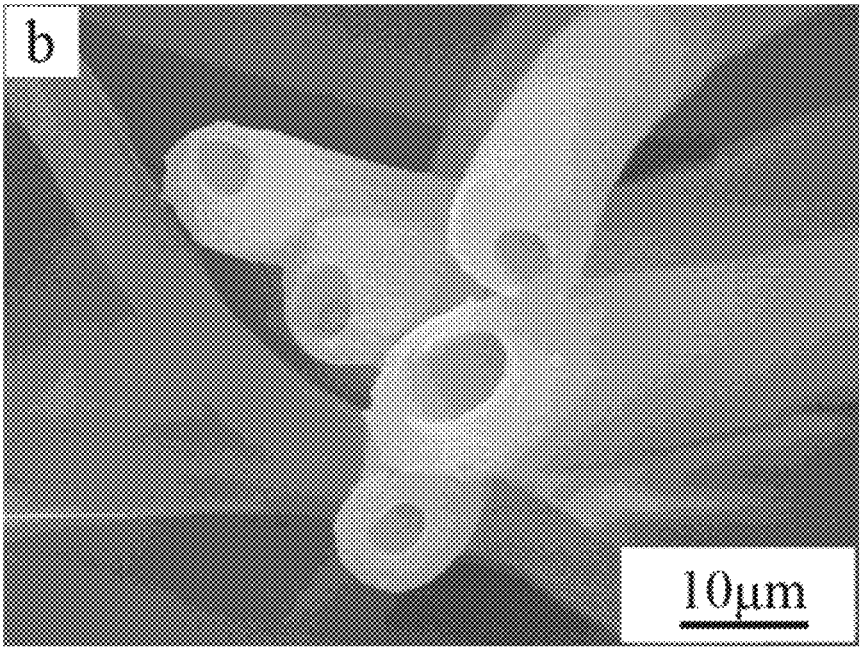

To mitigate the influence of residual DMSO on microtubule smoothness, a coagulating agent, H2O, is used to promote rapid solidification of PVDF. Due to the incompatibility between the two components, PVDF will coagulate rapidly by contact with H2O. As a result, PVDF surface remains smooth after coagulation. FIG. 16(*a*) shows the microtubules soaked into H2O for 30 min after collection. The post-treated microtubules show that both inner and outer surfaces possess a high degree of roughness. In order to improve the surface smoothness and overall morphology of microtubules, H2O bath as shown in FIG. 1 is used to prepare the PVDF/PVA microtubules. H2O coagulates and rinses the microtubules during electrospinning simultaneously. PVDF is solidified immediately at the time of fiber formation. A simultaneous H2O treatment completely eliminates the pitting effect of residual DMSO. After collection, the PVDF/PVA microtubules are kept under cold H2O over 12 h to wash away the residual DMSO. And then the microtubules are dried by a vacuum oven. Smoothness of inner and outer surfaces is significantly improved. PVDF/PVA exhibit more uniform hollow structures, as evident in an SEM micrograph in FIG. 16(*b*). Simultaneous H2O treatment presents an effective way to fabricate PVDF/PVA microtubules.

Capillary Action of PVDF/PVA Microtubule

Figure 17:
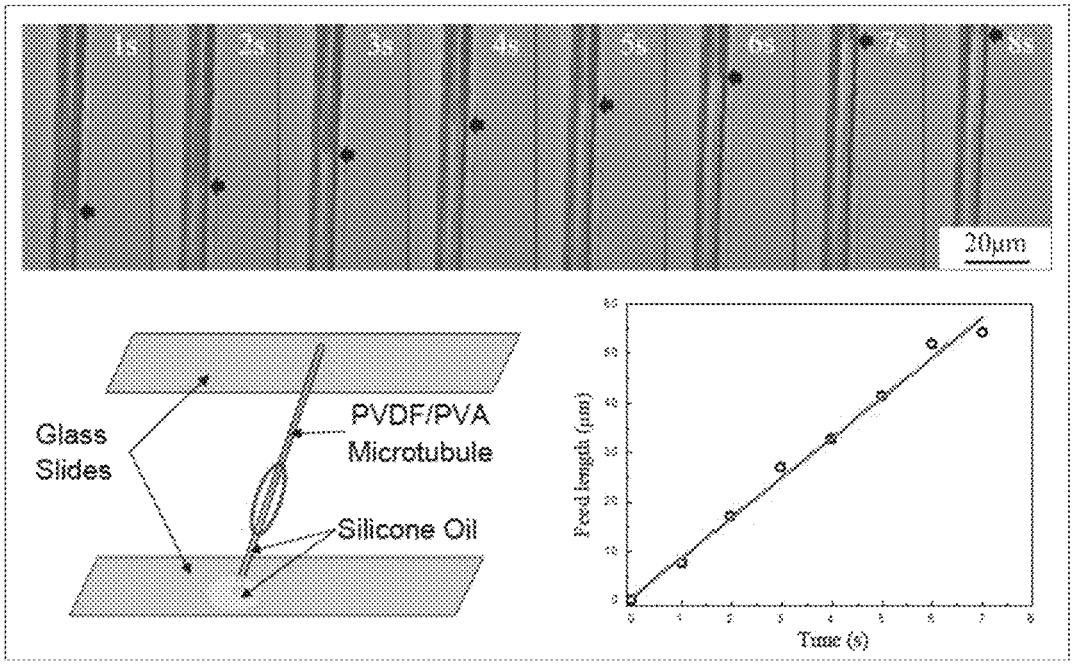
FIG. 17 provides a schematic representation of the wicking of silicone oil into a PVDF/PVA microtube and specific experimental images of the silicone oil wicking into the microtube, including a graph showing the feed length (i.e., the distance of wicking/travel into the microtube) versus time.

Capillary action is a well known phenomenon whereby liquid spontaneously rises inside a narrow capillary against gravity due to inter-molecular attractive forces such as by means of a combination of liquid surface tension and liquid-solid adhesion. As shown in FIG. 17, a VDF/PVA microtubule with an inner diameter of 5.14±0.21 μm is used in a wicking experiment. Silicone oil spontaneously rises in the center of PVDF/PVA microtubule, as represented by the arrows that show the level of the oil travelling up the tube. The only reason of silicone oil rising is the capillary action, and, notably, suspended nanoparticles would wick into the tubes just as readily. From the distance between the tip to meniscus vs. time curve, a straight line can be used to show a linear relationship. The slope of the line gives rise to a wicking rate, which is 8.08 μm/s. The linear relationship of the wicking curve also evidences the uniform hollow structure located in PVDF/PVA microtubules. The results confirm PVDF/PVA microtubules could be utilized as responsive fibers that can be controlled by mechano-electric coupling. The silicone oil can be modified to be a rheological fluid whereby mechanical deformation can be activated by electrical signals and vice versa.

In light of the foregoing, it should be appreciated that the present invention significantly advances the art by providing a microscale and nanoscale tubular structures advantageously filled with rheological fluid and including at least one electroactive polymer component. While particular embodiments of the invention have been disclosed in detail herein, it should be appreciated that the invention is not limited thereto or thereby inasmuch as variations on the invention herein will be readily appreciated by those of ordinary skill in the art. The scope of the invention shall be appreciated from the claims that follow.

What is claimed is:

1. A protective article comprising a non-woven fabric formed of one or more tubular structures in the microscale, the one or more tubular structures including a tube in the microscale and defining an interior volume; wherein said tube is formed of an electroactive polymer and a rheological fluid is retained within said interior volume, wherein said rheological fluid is selected from the group consisting of electro-rheological fluid and magneto-rheological fluid.

2. The protective article of claim 1, wherein said tube is devoid of a core material.

3. The protective article of claim 1, further comprising a second outer tube concentric with and surrounding said tube so as to define an annular space between said tube and said second outer tube.

4. The protective article of claim 3, wherein said core material is not present, such that said interior volume of said tube defines a hollow interior space, said rheological fluid being retained in either said hollow interior space only or in said hollow interior space and said annular space.

5. The protective article of claim 1, wherein said electroactive polymer is polyvinyldenefluoride (PVDF).

6. The protective article of claim 5, wherein the rheological fluid includes barium titanyl oxalate particles in silicone oil.

7. The protective article of claim 6, wherein the barium titanyl oxalate particles are nanoparticles with an average diameter of 50-70 nm.

8. The protective article of claim 1, wherein the protective article is a ballistic resistant fabric.

9. The protective article of claim 1, wherein the non-woven fabric is electrospun.

10. The protective article of claim 9, wherein the electrospun, non-woven fabric is made using a coaxial spinneret including a central spinning needle and an outer spinning needle.

* * * * *